United States Patent [19]

Bonanno

[11] Patent Number: 4,771,517

[45] Date of Patent: Sep. 20, 1988

[54] CLIP LOCKING CONSTRUCTION FOR SHOWER CURTAINS

[76] Inventor: Vincent L. Bonanno, 87-50 Kingston Pl., Jamaica, N.Y. 11432

[21] Appl. No.: 70,345

[22] Filed: Jul. 6, 1987

[51] Int. Cl.[4] ..... A47H 1/00

[52] U.S. Cl. ..... 24/462; 24/304; 160/DIG. 6

[58] Field of Search ..... 24/460, 461, 462, 304, 24/306, 297, 442, 444; 160/DIG. 6, DIG. 16, 368 R, 330, 348, 392, 395, 400

[56] References Cited

U.S. PATENT DOCUMENTS

| | | | |
|---|---|---|---|
| 2,148,401 | 2/1939 | Ellis, Jr. | 160/DIG. 6 |
| 2,211,958 | 8/1940 | Mahaffey | 160/368 R |
| 2,303,502 | 12/1942 | Rous | 160/DIG. 6 |
| 3,205,547 | 9/1965 | Riekse | 24/462 |
| 3,235,926 | 2/1966 | Mates | 24/306 |
| 3,659,319 | 5/1972 | Erickson | 24/304 |
| 3,961,661 | 6/1976 | Tombu | 160/392 |
| 4,070,735 | 1/1978 | Canaday | 160/DIG. 6 |
| 4,280,258 | 7/1981 | Kunze | 24/30.5 R |
| 4,341,255 | 7/1982 | Mock | 24/462 |
| 4,672,723 | 6/1987 | Hugues et al. | 24/297 |

*Primary Examiner*—Victor N. Sakran

*Attorney, Agent, or Firm*—Charles E. Temko

[57] ABSTRACT

An improved two element locking construction for releasably securing the side edges of a shower curtain to the outer surface of a shower enclosure to prevent leakage of water outwardly of the enclosure and reduce the inward motion of the curtain. The construction includes a first element which is secured to a surface of the enclosure using a suitable pressure sensitive adhesive, the first element forming a recess. A second element is secured to a surface of the shower curtain adjacent a vertical edge, and has a shaped longitudinally extending projection selectively engageable with said first element in an interstice leading to said recess. Disengagement of the elements is accomplished by manually flexing a resilient wall of the first element to temporarily enlarge the insterstice engaging the projection on the second element.

3 Claims, 3 Drawing Sheets

CLIP LOCKING CONSTRUCTION FOR SHOWER CURTAINS

BACKGROUND OF THE INVENTION

This invention relates generally to the field of releasable latch-type devices employed for selectively interconnecting a pair of relatively movable members to form a closure. While the invention has particular application to the securing of a flexible shower curtain to the edge of a shower enclosure or the like, it will be readily appreciated that the invention has application to a variety of similar situations, such as accordian type interior doors and sliding interior panels and partitions.

It is known in the art to provide means for securing shower curtains in closed position to prevent or at least impede the passage of water outwardly of the shower enclosure and reduce the inward motion of the shower curtain, which may be an actual vertical shower enclosure, or a space located above a bathtub. Such devices have included vacuum cups, interconnectible fabric members (Velcro), weights attached to the lower edge of the curtain, clothes pin type clips and the like.

The use of most of the above constructions poses substantial disadvantages. Some are not readily installed by the user without resort to more than ordinary skills. Others are not very attractive from an aesthetic point of view. Still others are not readily operable by the wet hands of the user, and perhaps most serious, the cost of manufacture, in some instances is excessive.

What is, in essence, required in constructions of this type is a two-element interconnecting means which can be conveniently manufactured from rust-free, preferably synthetic resinous materials, which may be conveniently installed upon conventional tile-like surfaces of the shower enclosure, and to the outer surface of the shower curtain, adjacent an edge, using only ordinary skills, and which may be readily engaged and disengaged by the user with little force, without the use of precise motor movements.

SUMMARY OF THE INVENTION

Briefly stated, the invention contemplates the provision of an improved locking construction of the type described in which the above-mentioned criteria are substantially met. The disclosed device includes first and second cooperating elements, each of which may be conveniently formed from synthetic resinous materials using known injection molding or extrusion techniques. A first element is adapted to be secured to a tile or other smooth surface of a shower enclosure using a pressure sensitive adhesive. A second element is secured, also using a pressure sensitive adhesive to an outer surface of a suspended shower curtain adjacent a vertical edge thereof to selectively engage the first element. The first element is of generally hollow triangular configuration, and includes a pair of mutually angularly disposed walls defining a slot-like opening therebetween of predetermined cross-sectional configuration. One of the walls is resiliently flexible to momentarily enlarge the width of the opening. The second element is of generally planar configuration with a flexible main wall having a laterally extending rail-like projection of cross-sectional configuration conforming to that of the opening in the first element to be selectively secured thereby. The cross-sectional configuration of the projection is such as to provide a cam-like action upon the slot to enlarge the same until the projection is seated, during which time, the flexible wall is returned to exert a snap action to secure the second element. When it is desired to disengage the first and second elements, manual pressure is applied to the flexible wall of the first element to enlarge the width of the slot, through the plane of the shower curtain, and maintained during disengagement.

BRIEF DESCRIPTION OF THE DRAWING

In the drawings, to which reference will be made in the specification, similar reference characters have been employed to designate corresponding parts throughout the several views.

DETAILED DESCRIPTION OF THE DISCLOSED EMBODIMENT

Figure 1:
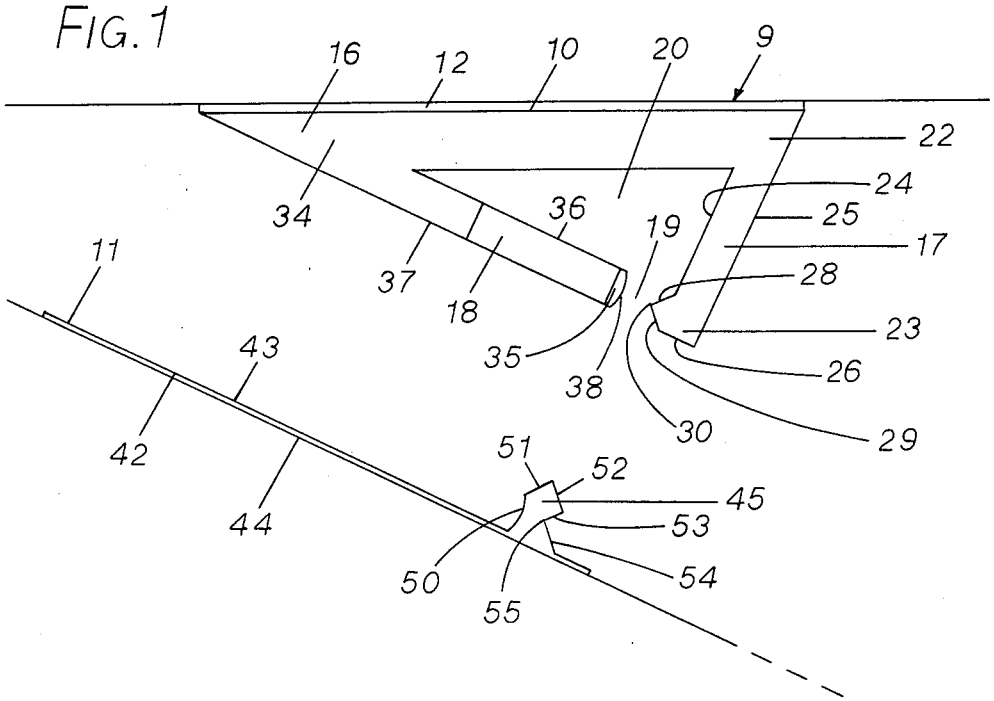
FIG. 1 is a schematic exploded top plan view of an embodiment of the invention, showing the component elements thereof in disengaged condition.

In accordance with the invention, the device, generally indicated by reference character 9, comprises first and second interconnecting elements 10 and 11, respectively. Each of these elements is preferably formed as a continuous extrusion from synthetic resinous materials of known type, which extrusions are transversely severed at convenient intervals to form individual substantially identical structures.

The first element 10 is adapted to be attached to a tile wall surface, using a suitable pressure-sensitive adhesive ( 12 ), and is of generally hollow triangular shape. It includes a base wall 16, a first laterally extending wall 17, and a second laterally extending wall 18, the free ends of the walls 17 and 18 defining a slotted opening 19 of predetermined cross-section leading to a hollow interior 20.

The first laterally extending wall 17 includes an interconnected end 22 and a free end 23 and is bounded by inner and outer surfaces 24 and 25. Adjacent an end surface 26 is a laterally extending projection of generally triangular configuration bounded by tapering surfaces 28 and 29 which meet at a transversely extending line of interconnection 30.

The second laterally extending wall 18 includes an interconnected end 34, and a free end 35. It is bounded by inner and outer surfaces 36 and 37 as well as a curved end surface 38 which defines part of an interstice or slot 19 of generally K-shaped cross section.

The second element 11 is adapted to be attached to a surface of a shower curtain adjacent a free vertical edge thereof, and includes a planar flexible wall 42 of thickness comparable to that of the shower curtain. It is bounded by first and second surfaces 43 and 44, the second surface being provided with a pressure sensitive adhesive (not shown) to permit it to be interconnected to the outer surface of the shower curtain. A rail-like projection 45 extends laterally from the surface 43. The projection 45 is bounded by axially extending surfaces such that the cross-section of the projection corresponds to that of the interstice 19. It includes a curved surface 50, first and second planar surfaces 51 and 52, which form an opening camming means, as well as third and fourth surfaces 53 and 54 which meet at a line of interconnection 55 to form a locking notch.

Figure 2:
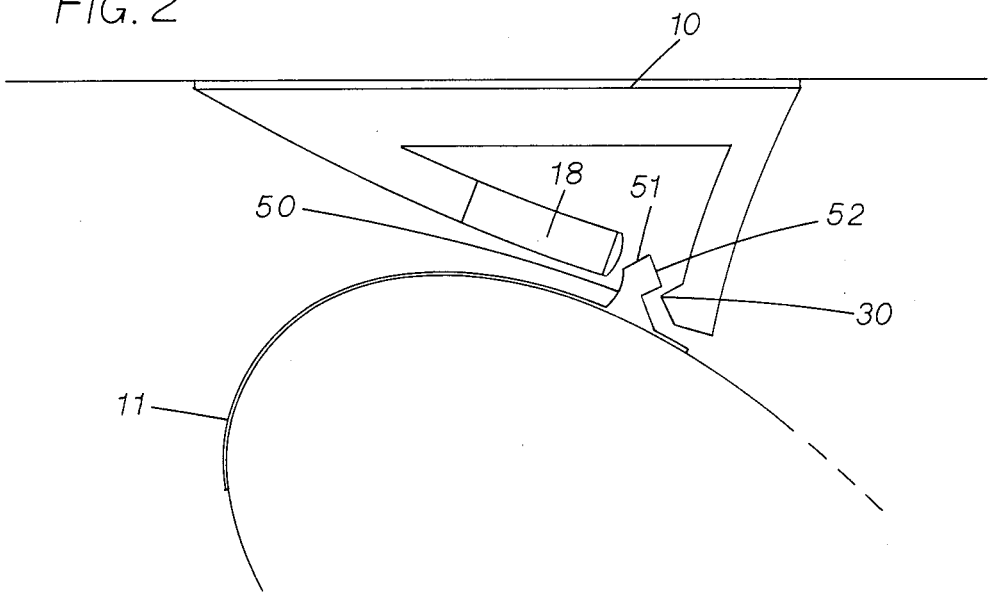
FIG. 2 is a similar view showing a first step in the engagement of the component elements.
Figure 3:
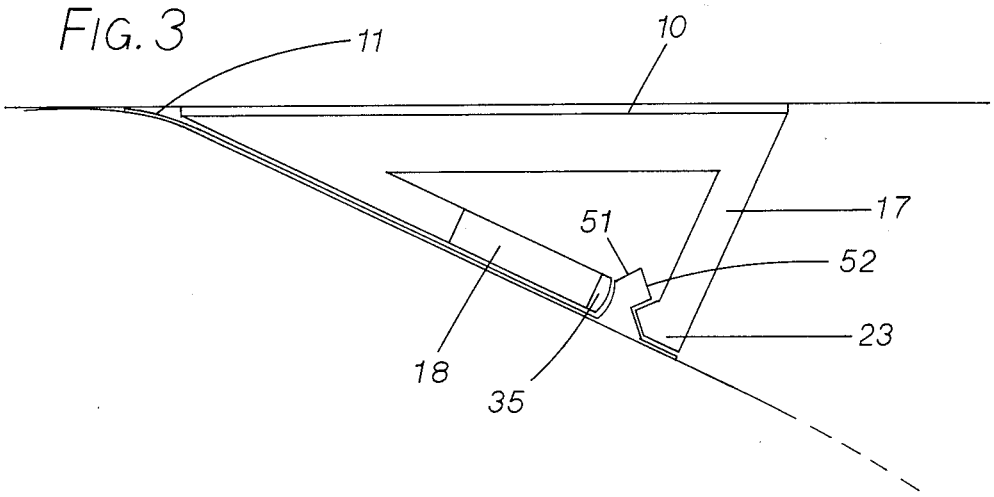
FIG. 3 is a similar view showing a second stage thereof in which the component elements are fully engaged.
Figure 4:
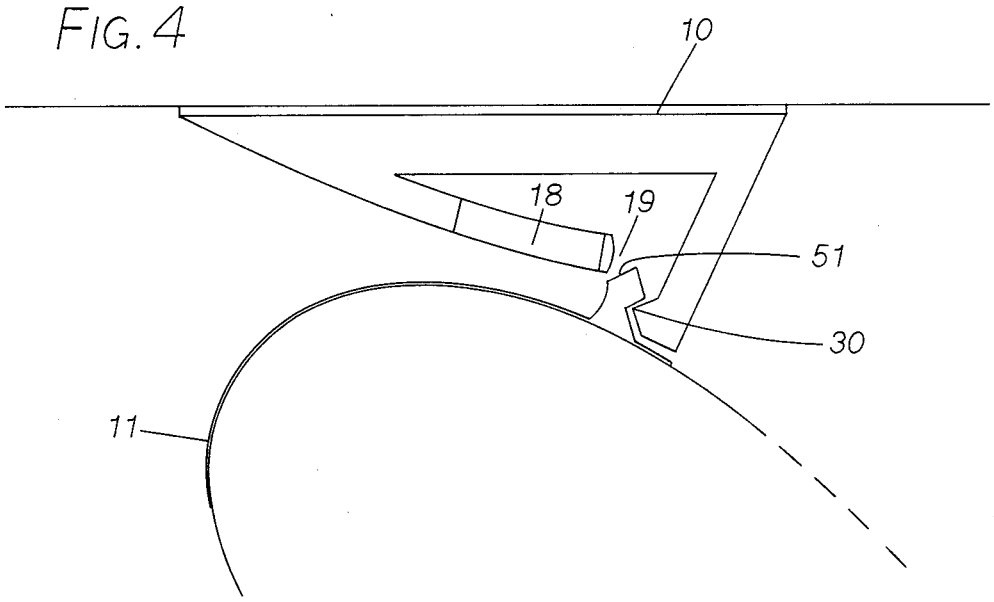
FIG. 4 is a similar view showing the disengagement of the component parts.

Referring to FIG. 2, there is shown a first step in the engagement of the elements 10 and 11, in which the surfaces 51 and 52 serve to move the wall 17 inwardly to permit passage of the projection. In FIG. 3, the projection has been fully seated, and the camming means has been disengaged to permit the wall 17 to return to relatively unstressed condition with a snap action. The elements remain in interconnected condition until it is desired to open the shower curtain. This is accomplished by pressing through the plane of the shower curtain to apply a manual force similar to that exerted by the camming means, and maintaining the same until the second element 11 is passed outwardly of the interstice 19. FIG. 4 illustrates such disengagement.

Figure 5:
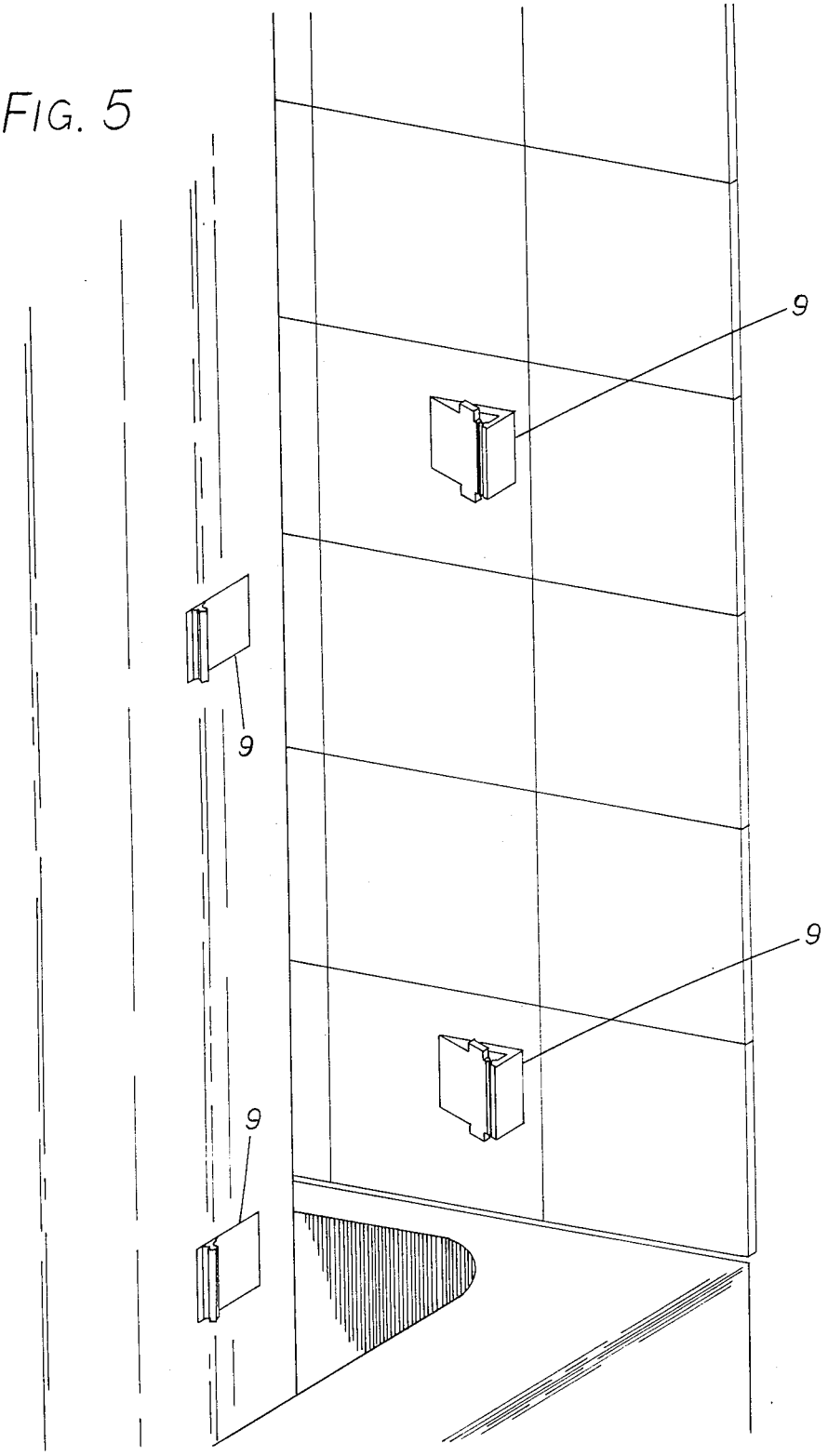
FIG. 5 is a fragmentary view in perspective showing the embodiment in engaged relation with a shower stall and shower curtain.

FIG. 5 shows a plurality of devices 9 in installed condition. Normally, three or four such devices, positioned at substantially equally spaced increments along the wall of the shower enclosure will be adequate. Where the shower stall is part of a bathtub enclosure, the vertical height of the shower curtain and its position will make each of the elements relatively accessible to the user without difficulty. Where the shower curtain is longer, placing the units to extend downwardly approximately two-thirds to three-quarters of the entire length will normally be sufficient.

It may thus be seen that I have invented novel and highly useful improvements in the clip type interlocking structure, suitable not only for interconnecting a flexible shower curtain at a vertical edge thereof to a shower enclosure, but also suitable for many similar purposes with relatively minor adaptation. Relatively thin gauge folding doors or interior panels may also be temporarily secured in desired position in a similar fashion.

I wish it to be understood that I do not consider the invention to be limited to the precise details of structure shown and set forth in this specification, for obvious modifications will occur to those skilled in the art to which the invention pertains.

I claim:

1. An improved clip locking construction for use in interconnecting an edge of a flexible curtain to an abutting surface of an enclosure comprising: a first interlocking element including a base wall adapted to be attached to said abutting surface and first and second walls extending laterally from the plane of said base wall; said first and second walls having free edge portions defining an elongated interstice therebetween of predetermined cross-sectional shape, at least one of said first and second walls being manually resiliently flexible in a direction toward and away from said base wall, and in relatively unstressed condition maintaining said interstice at minimum width; a second interconnecting element including a flexible base wall adapted to be interconnected along a first surface thereof to a surface of said curtain adjacent said free edge thereof, said second interconnecting element having a laterally extending rail-like projection having a cross-sectional configuration corresponding to that of said interstice, and adapted to be placed in congruent relation thereto to engage said first and second elements upon the flexing of said flexible wall of said first interlocking element.

2. A locking construction in accordance with claim 1, further characterized in the provision of camming means on said second interlocking element serving to deflect said flexible wall to enlarge said interstice upon the engagement of said elements, said flexible wall exhibiting a snap action upon the passing of said camming means through said interstice.

3. A locking construction in accordance with claim 1, further characterized in said interstice being of generally K-shaped configuration when said flexible wall of said first interconnecting element is in relatively unstressed condition.

* * * * *